US008636849B2

(12) United States Patent
Choi et al.

(10) Patent No.: US 8,636,849 B2
(45) Date of Patent: Jan. 28, 2014

(54) DISH WASHER AND METHOD FOR CONTROLLING THE SAME

(75) Inventors: Sang Soo Choi, Suwon-si (KR); Shimotera Kennichi, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1217 days.

(21) Appl. No.: 12/007,472

(22) Filed: Jan. 10, 2008

(65) Prior Publication Data

US 2008/0314410 A1 Dec. 25, 2008

(30) Foreign Application Priority Data

Jun. 25, 2007 (KR) ..... 10-2007-0062456

(51) Int. Cl.
*B08B 7/00* (2006.01)

(52) U.S. Cl.
USPC ..... 134/19; 134/18; 15/1

(58) Field of Classification Search
None
See application file for complete search history.

(56) References Cited

U.S. PATENT DOCUMENTS 5,797,409 A * 8/1998 Cooper et al. ..... 134/18
2005/0161064 A1 7/2005 Clouser

FOREIGN PATENT DOCUMENTS

DE 4142517 6/1993
JP 8019505 1/1996
KR 10-2005-0105721 11/2005

OTHER PUBLICATIONS

European Search Report dated Oct. 21, 2009 in European Patent Application 08150219.7.

* cited by examiner

*Primary Examiner* — Eric Golightly
(74) *Attorney, Agent, or Firm* — Staas & Halsey LLP

(57) ABSTRACT

Disclosed herein are a dish washer which is capable of finishing a rinse mode within a predetermined time by changing an operation start time of a heater according to the temperature of washing water at the time of a final rinse mode of the dish washer, and a method of controlling the same. The method of controlling the dish washer including a washing tub for containing dishes to be washed using washing water and a heater for heating the washing water includes sensing a temperature of the washing water, determining an operation start time of the heater on the basis of the sensed temperature of the washing water, and operating the heater according to the determined operation start time of the heater.

5 Claims, 5 Drawing Sheets

DISH WASHER AND METHOD FOR CONTROLLING THE SAME

CROSS-REFERENCE TO RELATED APPLICATIONS

This application claims the priority benefit of Korean Patent Application No. 2007-0062456, filed on Jun. 25, 2007 in the Korean Intellectual Property Office, the disclosure of which is incorporated herein by reference.

BACKGROUND

1. Field

Embodiments relate to a dish washer and a method of controlling the same, and, more particularly, to a dish washer which is capable of performing a rinse mode within a predetermined time by changing an operation start time of a heater according to the temperature of washing water at the time of a final rinse mode, and a method of controlling the same.

2. Description of the Related Art

Generally, a dish washer for spraying cold or hot washing water to dishes at a high pressure and removing a contaminant (garbage) from the dishes is disclosed in Korean Unexamined Patent Publication No. 2005-0105721.

The dish washer disclosed in the above Publication includes a washing tub which contains dishes to be washed, a plurality of dish baskets which is provided in the washing tub, for containing the dishes therein, spraying nozzles which are provided at the upper and lower sides of the plurality of dish baskets, for spraying washing water, and a sump which is connected to the spraying nozzles, for pumping the washing water to the spraying nozzles.

In the dish washer, when washing water is supplied into the washing tub in a state in which dishes to be washed are contained in the dish baskets, a circulation pump included in the sump is operated so as to move the washing water to the spraying nozzles, and the washing water is then sprayed to the dishes at a high pressure so as to wash the dishes. A wash process (including a wash mode and a rinse mode) generally includes a main mode (a main wash mode or a final rinse mode) and a preliminary mode (a preliminary wash mode or a preliminary rinse mode), all of which are repeatedly performed four to six times according to a course. After the final rinse mode is finished, a drying mode for drying wet dishes using a heater is performed.

In the conventional dish washer, the heater for heating the washing water is operated after a lapse of a predetermined time (after about 14 minutes) from starting of the final rinse mode such that the temperature of the washing water reaches a target temperature of about 60° C. (the temperature of the washing water necessary for improving rinse performance and drying performance). Thus, it is possible to improve the rinse performance of the rinse mode and the drying performance of the drying mode after the rinse mode is finished.

In the conventional dish washer, since the operation of the heater is started after the lapse of the predetermined time from the starting of the final rinse mode (after about 14 minutes), if the temperature of the washing water supplied for the rinse mode is low, it takes much time for the temperature of the washing water to reach the target temperature (about 60° C.) and thus a final rinse time becomes longer than a predetermined time (about 30 minutes). Referring to FIG. 1, when the temperature of the washing water is equal to or greater than 49° C. and the heater is operated after the lapse of the predetermined time (after about 14 minutes) from the starting of the final rinse mode, the temperature of the washing water reaches the target temperature when the final rinse mode is finished (see (a) of FIG. 1). In contrast, when the temperature of the washing water is less than 49° C. and the heater is operated after the lapse of the predetermined time (after about 14 minutes) from the starting of the final rinse mode, the temperature of the washing water does not reach the target temperature (about 60° C.) when the final rinse mode is finished. Accordingly, since the heater is continuously operated until the temperature of the washing water reaches the target temperature (about 60° C.), the operation time of the heater becomes longer and thus a rinse time becomes longer (see (b) of FIG. 1). If the rinse time becomes longer, the subsequent drying mode is delayed and an actual washing time becomes different from a total washing time displayed to a user, thereby leading to dissatisfaction of the user.

SUMMARY

In an aspect of embodiments, there is provided a dish washer which is capable of finishing a rinse mode within a predetermined time by sensing the temperature of washing water and changing an operation start time of a heater at the time of a final rinse mode, and a method of controlling the same.

In another aspect of embodiments, there is provided a dish washer which is capable of preventing a mode from being delayed and improving drying performance by changing an operation start time of a heater according to the temperature of washing water at the time of a final rinse mode such that a start time of the drying mode is always uniformly maintained, and a method of controlling the same.

In an aspect of embodiments, there is provided a method for controlling a dish washer including a washing tub for containing dishes to be washed using washing water and a heater for heating the washing water, the method including: sensing a temperature of the washing water; determining an operation start time of the heater based on the sensed temperature of the washing water; and operating the heater based on the determined operation start time of the heater.

According to another aspect of embodiments, there is provided a method for controlling a dish washer, the method including: sensing a temperature of washing water while dishes are washed using the washing water; determining a heating start time of the washing water based on the sensed temperature of the washing water; and operating a heater based on the determined heating start time of the washing water and heating the washing water.

The sensing of the temperature of the washing water may include sensing the temperature of the washing water at the time of a final rinse mode of the dish washer.

The sensing of the temperature of the washing water may include sensing the temperature of the washing water immediately after the supply of the washing water necessary for the final rinse mode is finished.

The determining of the operation start time of the heater may include determining the operation start time of the heater such that the temperature of the washing water reaches a target temperature when the final rinse mode is finished.

The determining of the operation start time of the heater may include determining a heating start time of the washing water such that the operation start time of the heater after starting the final rinse mode is advanced as the temperature of the washing water is decreased.

The determining of the heating start time of the washing water may include determining the operation start time of the heater such that the temperature of the washing water reaches a target temperature when the final rinse mode is finished.

The determining of the heating start time of the washing water may include determining the heating start time of the washing water such that the operation start time of the heater after starting the final rinse mode is advanced as the temperature of the washing water is decreased.

In an aspect of embodiments, there is provided a method for controlling a dish washer including a washing tub for containing dishes to be washed using washing water and a heater for heating the washing water, the method including: sensing a temperature of the dish washer while the dishes are washed using the washing water; and determining an operation start time of the heater such that the sensed temperature of the dish washer reaches a target temperature within a predetermined time.

The sensing of the temperature of the dish washer may include sensing the temperature of the washing water at the time of a final rinse mode of the dish washer.

The sensing of the temperature of the dish washer may include sensing the temperature of the washing tub at the time of a rinse mode of the dish washer.

The predetermined time may be a rinse time.

According to another aspect of embodiments, there is provided a dish washer including: a washing tub which contains dishes to be washed using washing water; a heater which heats the washing water; a temperature sensing unit which senses a temperature of the washing water; and a control unit which determines an operation start time of the heater based on the sensed temperature of the washing water and which controls an operation of the heater based on the determined operation start time of the heater.

The temperature sensing unit may sense the temperature of the washing water at the time of a final rinse mode of the dish washer.

The temperature sensing unit may sense the temperature of the washing water immediately after the supply of the washing water necessary for the final rinse mode is finished.

The control unit may determine the operation start time of the heater such that the temperature of the washing water reaches a target temperature when the final rinse mode is finished.

The control unit may determine a heating start time of the washing water such that the operation start time of the heater after starting the final rinse mode is advanced as the temperature of the washing water is decreased.

According to another aspect of embodiments, there is provided a method for controlling dish washer having a heater and containing washing water, the method including determining an operation start time of the heater such that a temperature of the washing water of the dish washer reaches a target temperature within a predetermined time; and operating the heater based on the determined operation start time to heat the washing water.

According to another aspect of embodiments, there is provided a dish washer including a washing tub which contains dishes to be washed using washing water; a heater to heat the washing water; a temperature sensor to sense a temperature of the washing water; and a control unit to determine an operation start time of the heater based on the sensed temperature of the washing water such that the temperature of the washing water reaches a target temperature within a predetermined time and to control an operation of the heater based on the determined operation start time of the heater to heat the washing water.

BRIEF DESCRIPTION OF THE DRAWINGS

These and/or other aspects, features, and advantages will become apparent and more readily appreciated from the following description of exemplary embodiments, taken in conjunction with the accompanying drawings of which.

DETAILED DESCRIPTION OF EMBODIMENTS

Figure 1:
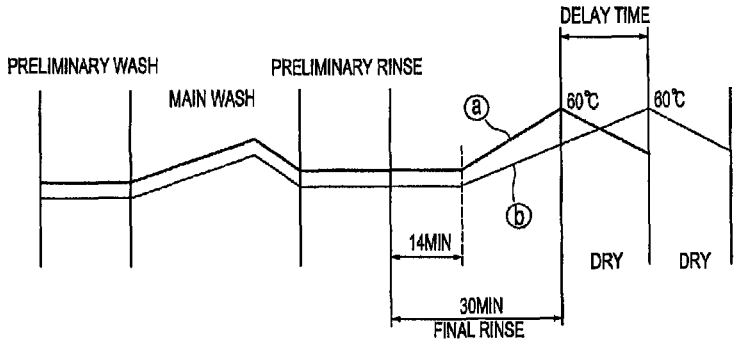
FIG. 1 PRIOR ART
FIG. 1 is a graph showing an operation start time of a heater of a conventional dish washer.

Reference will now be made in detail to exemplary embodiments, examples of which are illustrated in the accompanying drawings, wherein like reference numerals refer to the like elements throughout. Exemplary embodiments are described below by referring to the figures.

Figure 2:
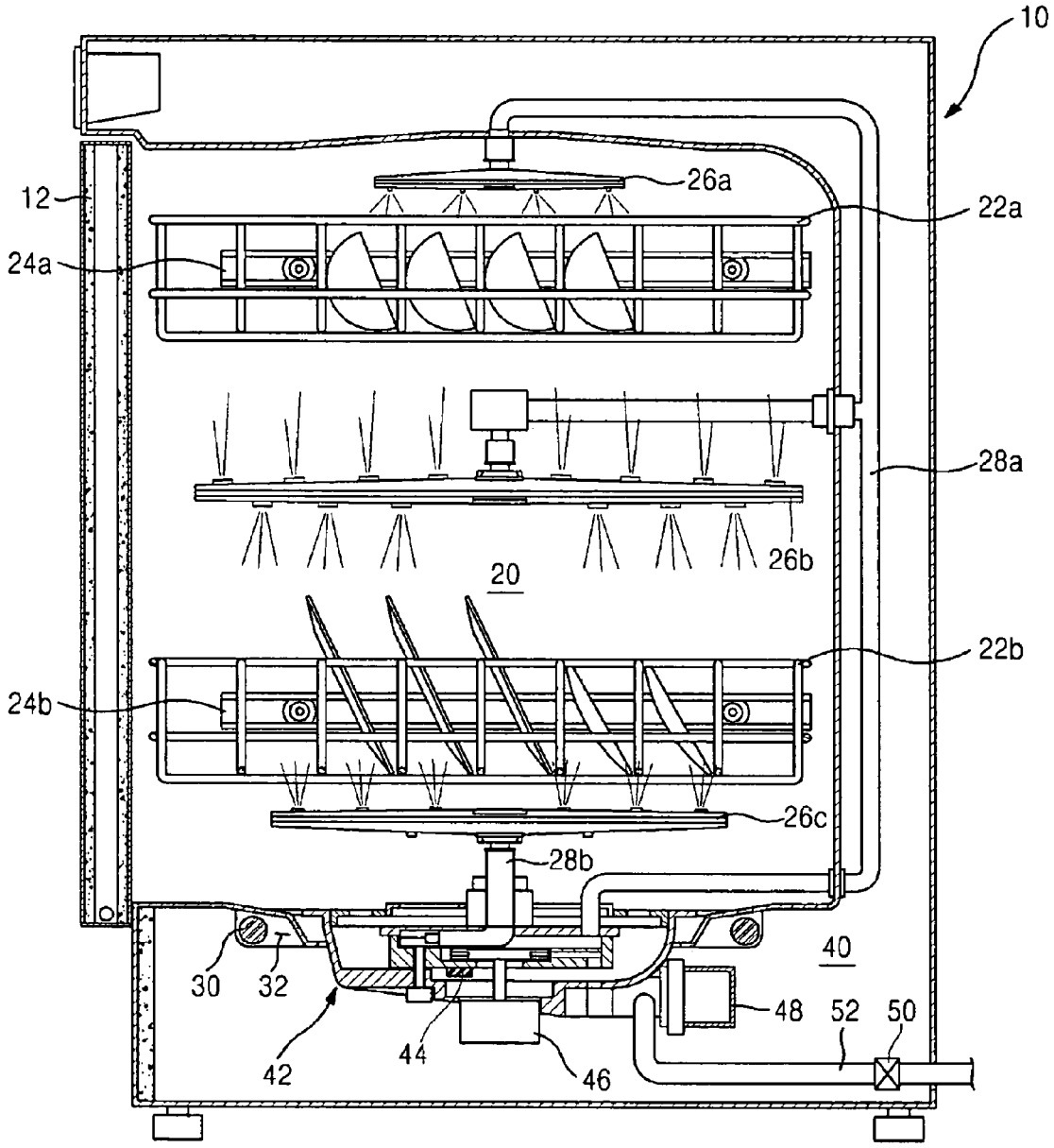
FIG. 2 is a side cross-sectional view showing the configuration of a dish washer according to an exemplary embodiment.

FIG. 2 is a side cross-sectional view showing the configuration of a dish washer according to an exemplary embodiment.

In FIG. 2, the dish washer according to an exemplary embodiment includes a main body 10 having a washing space therein and a door 12 for opening and closing a front surface of the main body 10, both of which form an appearance.

The main body 10 includes a washing tub 20 which contains dishes to be washed. The washing tub 20 includes upper and lower dish baskets 22*a* and 22*b* which contain dishes therein, racks 24*a* and 24*b* for slidably supporting the upper and lower dish baskets 22*a* and 22*b*, and an upper spraying nozzle 26*a*, a middle spraying nozzle 26*b* and a lower spraying nozzle 26*c* which are provided above and below the upper and lower dish baskets 22*a* and 22*b*, for spraying washing water.

The upper spraying nozzle 26*a* and the middle spraying nozzle 26*b* are connected to a sump 42 through a first supply pipe 28*a* and the lower spraying nozzle 26*c* is connected to the sump 42 through a second supply pipe 28*b*, thereby receiving the washing water.

The washing water supplied to the upper spraying nozzle 26*a* and the middle spraying nozzle 26*b* through the first supply pipe 28*a* and the washing water supplied to the lower spraying nozzle 26*c* through the second supply pipe 28*b* are separately sprayed according to the operation of the upper spraying nozzle 26*a* and the middle spraying nozzle 26*b* or the operation of the lower spraying nozzle 26*c*. In this case, a channel switching device may be separately provided or valves may be provided to the first and second supply pipes 28*a* and 28*b*.

Meanwhile, a plurality of spraying holes for spraying the washing water to the upper side of the middle spraying nozzle 26*b* and a plurality of spraying holes for spraying the washing water to the lower side of the middle spraying nozzle 26*b* are formed in the middle spraying nozzle 26*b* such that the washing water is simultaneously sprayed to the upper and lower sides of the middle spraying nozzle 26*b*.

A heater 30 for heating the washing water is provided on the bottom of the washing tub 20 and is contained in a heater installation groove 32 formed in the bottom of the washing tub 20.

A mechanical chamber 40 is provided below the washing tub 20. The sump 42 for collecting, pumping and moving the washing water to be supplied into the washing tub 20 to the upper, middle and lower spraying nozzles 26*a*, 26*b* and 26*c* is provided in the mechanical chamber 40. A temperature sensor 44 for sensing the temperature of the washing water is provided in the sump 42.

A variety of channels and a circulation pump 46 for pumping water to the channels are provided in the sump 42. A water draining pump 48 and a water draining valve 50 for draining contaminated washing water through a water draining pipe 52 are provided at one side of the sump 42.

Figure 3:
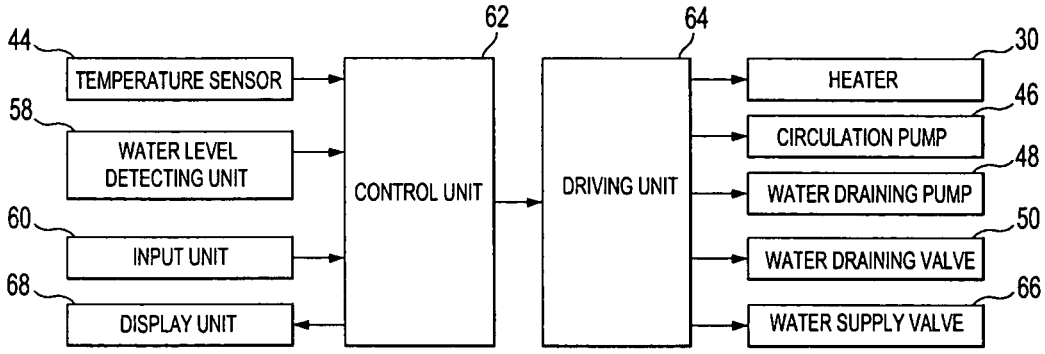
FIG. 3 is a block diagram showing the control configuration of the dish washer according to an exemplary embodiment.

FIG. 3 is a block diagram showing the control configuration of the dish washer according to an exemplary embodiment. The dish washer includes a water level detecting unit 58, an input unit 60, a control unit 62, a driving unit 64 and a display unit 68 in addition to the elements shown in FIG. 2.

The water level detecting unit 58 detects the amount (water level) of the washing water supplied to the washing tub 20. The input unit 60 inputs a variety of washing courses (e.g., a standard course and a manual course) and operation information such as the temperature of the washing water and the addition of the rinse mode to the control unit 62 by a command of a user.

The washing course includes a standard course for sequentially performing a water supplying mode for supplying washing water, a wash mode for spraying the washing water to the dishes and washing the dishes, a heating mode for heating the washing water to a temperature suitable for the wash and the rinse before spraying the washing water to the dishes, a water draining mode for draining the washing water after the wash, and a drying mode for drying the washed dishes after the wash. The washing course also includes a manual course for allowing the user to optionally select and operate the modes.

The control unit 62 is a microprocessor which operates the dish washer according to the operation information input through the input unit 60 and controls the wash, rinse and drying modes. At the time of a final rinse mode, the control unit 62 senses the temperature of the washing water supplied into the washing tub 20 through the temperature sensor 44 and changes the operation start time of the heater 30 according to the sensed temperature of the washing water as follows.

(1) If the temperature of the washing water is equal to or greater than 49° C., then the heater 30 is operated after 14 minutes from the starting of the final rinse.

(2) If the temperature of the washing water is in a range from 45 to 48° C., then the heater 30 is operated after 12 minutes from the starting of the final rinse.

(3) If the temperature of the washing water is in a range from 41 to 44° C., then the heater 30 is operated after 10 minutes from the starting of the final rinse.

(4) If the temperature of the washing water is in a range from 35 to 40° C., then the heater 30 is operated after 8 minutes from the starting of the final rinse.

(5) If the temperature of the washing water is in a range from 30 to 34° C., then the heater 30 is operated after 5 minutes from the starting of the final rinse.

(6) If the temperature of the washing water is in a range from 25 to 29° C., then the heater 30 is operated after 3 minutes from the starting of the final rinse.

(7) If the temperature of the washing water is less than 24° C., then the heater 30 is simultaneously operated when the final rinse mode is started.

When the control unit 62 changes the operation start time of the heater 30 according to the temperature of the washing water, the temperature of the washing water reaches the target temperature (about 60° C.) when the final rinse mode is finished (after about 30 minutes). Accordingly, the operation of the heater 30 and the final rinse mode are simultaneously finished such that the rinse mode is not delayed and drying performance is improved.

When the temperature of the washing water is equal to or greater than 49° C., the control unit 62 divides the temperature range of the washing water by 3° C. and delays the operation start time of the heater 30 by 3 minutes according to the divided temperature range of the washing water as follows.

(8) If the temperature of the washing water is in a range from 49 to 52° C., then the heater 30 is operated after 17 minutes from the starting of the final rinse mode.

(9) If the temperature of the washing water is in a range from 53 to 56° C., then the heater 30 is operated after 20 minutes from the starting of the final rinse mode.

(10) If the temperature of the washing water is in a range from 57 to 60° C., then the heater 30 is operated after 23 minutes from the starting of the final rinse mode.

The control unit 62 performs the water supplying mode for opening the water supply valve 66 and supplying the washing water into the washing tub 20 at the time of the wash and rinse modes, the heating mode for operating the heater 30 and heating the washing water supplied into the washing tub 20 after supplying the water, the wash (or the rinse) mode for driving the circulation pump 46, spraying the washing water supplied into the washing tub 20 or heated washing water, and washing (or rinsing) dishes after supplying the water, and the water draining mode for opening the water draining valve 50, driving the water draining pump 48 and draining the washing water from the washing tub 20 after the wash.

The driving unit 64 drives the heater 30, the circulation pump 46, the water draining pump 48, the water draining valve 50, and the water supply valve 66 according to a drive control signal of the control unit 62. The water supply valve 66 controls the supply of the washing water supplied into the washing tub 20.

The display unit 68 displays an operation state (e.g., a total mode time) and an error of the dish washer according to a display control signal of the control unit 62.

Hereinafter, the operation and the effect of the dish washer and the method of controlling the same will be described.

Figure 4:
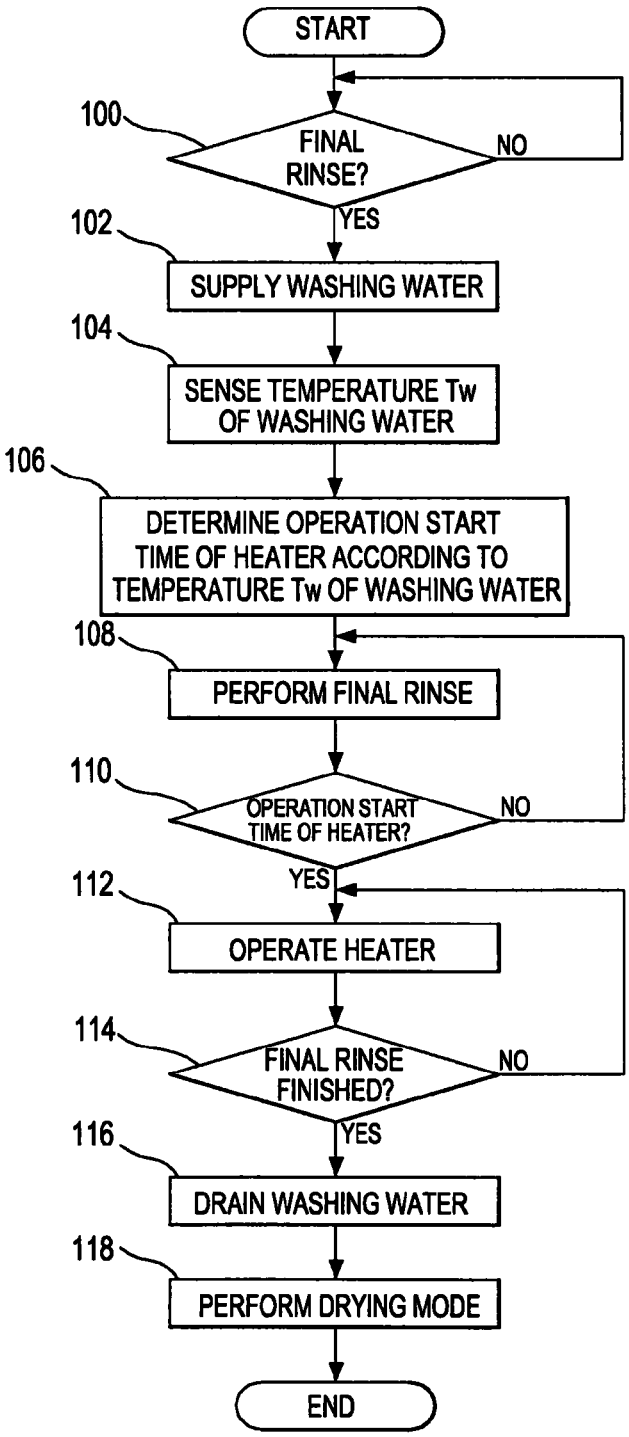
FIG. 4 is a flowchart illustrating a method of controlling the dish washer according to an exemplary embodiment.

FIG. 4 is a flowchart illustrating a method of controlling the dish washer according to an exemplary embodiment.

When a user selects a wash course (e.g., the standard course) and desired operation information in a state in which dishes to be washed are contained in the dish baskets 22*a* and 22*b* of the washing tub 20, the operation information selected by the user is input to the control unit 62 through the input unit 60.

Accordingly, the control unit 62 starts to sequentially perform a preliminary wash mode (a washing time of about 15 minutes), a main wash mode (a washing time of about 30 minutes and a temperature of washing water of about 50° C.), a preliminary rinse mode (a rinse time of about 5 minutes), a final rinse mode (a rinse time of about 30 minutes and a temperature of rinsing water of about 60° C.), and a drying mode. At this time, the control unit 62 displays the total washing time of the modes through the display unit 68 such that the user can easily confirm the washing time.

Thereafter, the control unit 62 determines whether a mode which is currently being performed is the final rinse mode (100). If it is determined to be the final rinse mode, the control unit 62 operates the water supply valve 66 through the driving unit 64 such that the washing water necessary for the final rinse mode is supplied into the washing tub 20 and the washing water supplied into the washing tub 20 is collected in the sump 42 provided below the washing tub 20 (102).

When the washing water necessary for the final rinse mode is supplied, the amount of washing water supplied into the washing tub 20 is detected by the water level detecting unit 58 such that the washing water is supplied up to a predetermined water level (a water level necessary for the final rinse mode).

When the washing water is supplied up to the predetermined water level, the temperature Tw of the supplied washing water is sensed by the temperature sensor 44 provided in the sump 42 and is input to the control unit 62 (104).

The control unit 62 determines the operation start time of the heater 30 according to the temperature Tw of the washing water sensed by the temperature sensor 44 as follows.

(1) If the temperature of the washing water is equal to or greater than 49° C., then the heater 30 is operated after 14 minutes from the starting of the final rinse.

(2) f the temperature of the washing water is in a range from 45 to 48° C., then the heater 30 is operated after 12 minutes from the starting of the final rinse.

(3) If the temperature of the washing water is in a range from 41 to 44° C., then the heater 30 is operated after 10 minutes from the starting of the final rinse.

(4) If the temperature of the washing water is in a range from 35 to 40° C., then the heater 30 is operated after 8 minutes from the starting of the final rinse.

(5) If the temperature of the washing water is in a range from 30 to 34° C., then the heater 30 is operated after 5 minutes from the starting of the final rinse.

(6) If the temperature of the washing water is in a range from 25 to 29° C., then the heater 30 is operated after 3 minutes from the starting of the final rinse.

(7) If the temperature of the washing water is less than 24° C., then the heater 30 is simultaneously operated when the final rinse mode is started.

After the control unit 62 determines the operation start time of the heater 30 according to the temperature Tw of the washing water, the washing water is moved to the upper spraying nozzle 26*a*, the middle spraying nozzle 26*b* and the lower spraying nozzle 26*c* through the first and second supply pipes 28*a* and 28*b* by the pumping operation of the circulation pump 46, and the washing water is sprayed to the dishes contained in the dish baskets 22 at a high pressure such that the final rinse mode for removing fine particles stuck to the dishes is started (108).

When the temperature of the washing water is equal to or greater than 49° C., the control unit 62 divides the temperature range of the washing water by 3° C. and delays the operation start time of the heater 30 by 3 minutes according to the divided temperature range of the washing water as follows.

(8) If the temperature of the washing water is in a range from 49 to 52° C., then the heater 30 is operated after 17 minutes from the starting of the final rinse mode.

(9) If the temperature of the washing water is in a range from 53 to 56° C., then the heater 30 is operated after 20 minutes from the starting of the final rinse mode.

(10) If the temperature of the washing water is in a range from 57 to 60° C., then the heater 30 is operated after 23 minutes from the starting of the final rinse mode.

Figure 5:
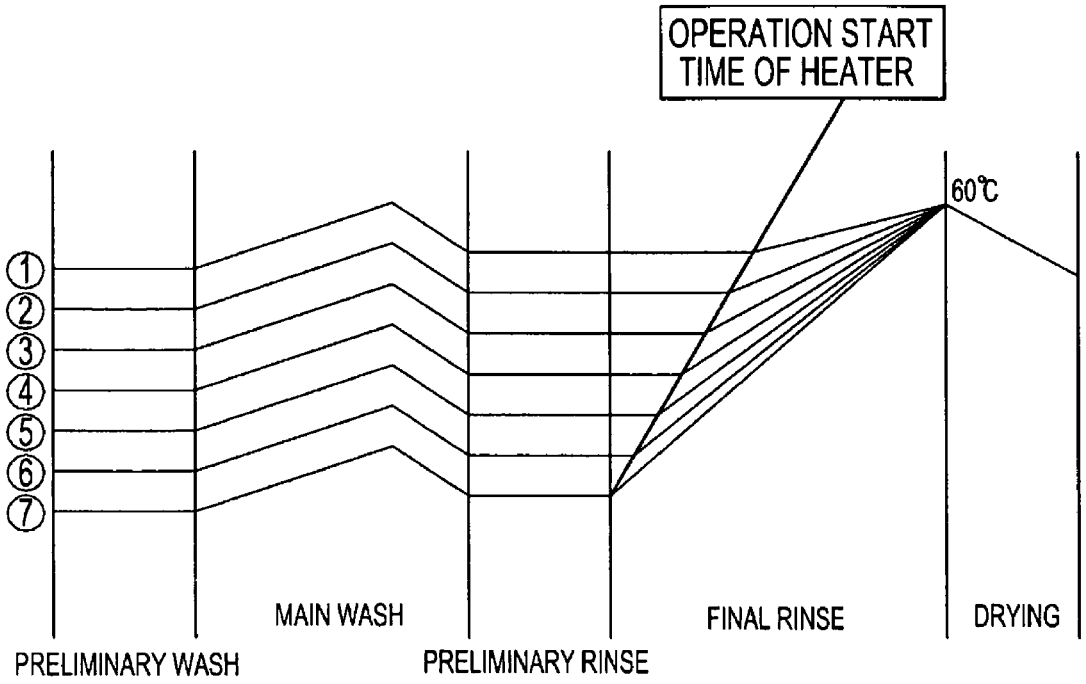
FIG. 5 is a graph showing an operation start time of a heater of the dish washer according to an exemplary embodiment.

When the final rinse mode is started, the control unit 62 counts a rinse time and determines whether the time reaches the operation start time of the heater 30 determined according to the temperature Tw of the washing water (110). If it is determined that the time reaches the operation start time of the heater 30, the heater 30 is operated by the driving unit 64 (112), as shown in FIG. 5.

When the heater 30 is operated at the operation start time of the heater 30, determined according to the temperature Tw of the washing water in the final rinse mode, the washing water collected in the sump 42 is heated such that the temperature of the washing water is increased.

Thereafter, the control unit 62 counts a final rinse time and determines whether a predetermined final rinse time (about 30 minutes) elapses, that is, whether the final rinse mode is finished (114). If it is determined that the final rinse is not finished, then the final rinse mode is performed while the heater 30 is continuously operated until the final rinse time elapses.

When the heater 30 is continuously operated from the operation start time of the heater 30, determined according to the temperature Tw of the washing water during the final rinse time, the temperature Tw of the washing water reaches the target temperature when the final rinse mode is finished (after about 30 minutes) such that the operation of the heater 30 and the final rinse mode are simultaneously finished. Thus, the rinse mode is not delayed and the drying performance is improved.

At this time, the control unit 62 displays a residual washing time through the display unit 68 as the modes progress, such that the user can easily confirm the residual washing time.

Although the operation start time of the heater 30 is changed according to the temperature Tw of the supplied washing water in an exemplary embodiment embodiments are not limited to this. Even when the operation start time of the heater 30 is changed according to an internal temperature of the washing tub 20, the same object and effect can be realized.

If it is determined that the final rinse mode is finished in Operation 114, the washing water and a fine contaminant stuck to the dishes are collected to the sump 42. The control unit 62 drains the washing water containing the contaminant through the water draining pipe 52 according to the operation of the water draining pump 48 and the water draining valve 50 (116) and performs the drying mode (118).

As described above, in the dish washer and the method of controlling the same according to an exemplary embodiment, since the temperature of the washing water is sensed to control the operation start time of the heater at the time of the final rinse mode, it is possible to finish the rinse mode within a predetermined time.

Since the operation start time of the heater is controlled according to the temperature of the washing water at the time of the final rinse mode such that the start time of the drying mode is always uniformly maintained regardless of the temperature of the washing water, the mode is not delayed and the drying performance is improved. Since an actual washing time is equal to the total washing time displayed to the user, it is possible to eliminate the dissatisfaction of the user.

Although a few exemplary embodiments have been shown and described, it would be appreciated by those skilled in the art that changes may be made in these exemplary embodiments, the scope of which is defined in the claims and their equivalents.

What is claimed is:

1. A method for controlling a dish washer including a washing tub containing dishes to be washed using washing water and a heater for heating the washing water, the method comprising:

sensing a temperature of the washing water;

determining an operation start time of the heater based on the sensed temperature of the washing water; and operating the heater based on the determined operation start time of the heater, wherein the sensing of the temperature of the washing water comprises sensing the temperature of the washing water immediately after supply of the washing water necessary for a final rinse mode to the washing tub is finished; and wherein the operation start time of the heater is determined such that the operation of the heater and the final rinse mode are simultaneously finished.

2. A method for controlling a dish washer, the method comprising:

sensing a temperature of washing water while dishes are washed using the washing water;

determining a heating start time of the washing water based on the sensed temperature of the washing water; and operating a heater based on the determined heating start time of the washing water to heat the washing water, wherein the sensing of the temperature of the washing water comprises sensing the temperature of the washing water at the time of a final rinse mode of the dish washer; and wherein the determining of the heating start time of the washing water comprises determining the operation start time of the heater such that the temperature of the washing water reaches a target temperature when the final rinse mode is finished, and wherein the operation start time of the heater is determined such that the operation of the heater and the final rinse mode are simultaneously finished.

3. The method according to claim 1, wherein the determining of the operation start time of the heater comprises determining the operation start time of the heater such that the temperature of the washing water reaches a target temperature when the final rinse mode is finished.

4. The method according to claim 3, wherein the determining of the operation start time of the heater comprises determining a heating start time of the washing water such that the operation start time of the heater after starting the final rinse mode decreases as the temperature of the washing water decreases.

5. The method according to claim 2, wherein the determining of the heating start time of the washing water comprises determining the heating start time of the washing water such that the operation start time of the heater after starting the final rinse mode decreases as the temperature of the washing water decreases.

* * * * *

UNITED STATES PATENT AND TRADEMARK OFFICE

CERTIFICATE OF CORRECTION

PATENT NO. : 8,636,849 B2
APPLICATION NO. : 12/007472
DATED : January 28, 2014
INVENTOR(S) : Choi et al.

It is certified that error appears in the above-identified patent and that said Letters Patent is hereby corrected as shown below:

In the Claims

Column 9, Lines 16-17, In Claim 2, after "washer;" delete "and".

Signed and Sealed this
First Day of July, 2014

Michelle K. Lee

Michelle K. Lee
*Deputy Director of the United States Patent and Trademark Office*